US007217052B2

(12) United States Patent
Burghaus

(10) Patent No.: US 7,217,052 B2
(45) **Date of Patent: *May 15, 2007**

(54) APPLICATOR FOR APPLYING AN OXIDATIVE HAIR DYE AND METHOD OF REPEATEDLY DYEING INDIVIDUAL HAIR STRANDS UNIFORMLY OR NON-UNIFORMLY WITH SAME

(75) Inventor: Johannes Burghaus, Gross-Umstadt (DE)

(73) Assignee: Wella AG, Darmstadt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/478,274

(22) Filed: Jun. 29, 2006

(65) Prior Publication Data

US 2007/0009312 A1 Jan. 11, 2007

Related U.S. Application Data

(62) Division of application No. 10/790,385, filed on Mar. 1, 2004, now Pat. No. 7,128,485.

(30) Foreign Application Priority Data

Apr. 5, 2003 (DE) ..... 103 15 550

(51) Int. Cl.

| | |
|---|---|
| ***B43K 27/04*** | (2006.01) |
| ***B43K 5/00*** | (2006.01) |
| ***B05C 1/00*** | (2006.01) |
| ***A47L 1/08*** | (2006.01) |
| ***B65D 1/24*** | (2006.01) |

(52) U.S. Cl. ..... 401/35; 401/17; 401/23; 401/202; 220/506

(58) Field of Classification Search ..... 401/17, 401/23, 34, 35, 202; 222/142.5; 132/108; 220/506; 206/514, 581, 229
See application file for complete search history.

(56) References Cited

U.S. PATENT DOCUMENTS

| | | | | |
|---|---|---|---|---|
| 4,795,156 | A * | 1/1989 | Paulish | 273/148 R |
| 5,048,990 | A * | 9/1991 | Hashimoto et al. | 401/107 |
| 5,848,730 | A * | 12/1998 | Kawase et al. | 222/94 |
| 7,001,091 | B1 * | 2/2006 | Knight | 401/47 |
| 2004/0161282 | A1 * | 8/2004 | Bolton | 401/35 |

* cited by examiner

*Primary Examiner*—David J. Walczak
(74) *Attorney, Agent, or Firm*—Michael J. Striker

(57) ABSTRACT

The method of oxidative dyeing of individual hair strands includes providing an applicator with a first and second compartment containing an oxidative hair dye composition and an oxidizing agent respectively and respective liquid-permeable inserts. The two compartments are provided with respective product-dispensing openings, which open next to each other into a product-dispensing area. The liquid-permeable inserts protrude somewhat beyond the product-dispensing openings and are made of spongy material, bristles, or a fabric. At least a portion of a hair strand to be dyed is wet with the oxidative hair dye composition and the oxidizing-agent-containing solution from the liquid-permeable inserts so that a reactive hair dyeing mixture is formed on the hair strand. The hair dyeing mixture is worked or massaged into the hair strand by hand. The individual hair strand may be uniformly dyed or dyed in a point-like or spot-like pattern.

9 Claims, 3 Drawing Sheets

APPLICATOR FOR APPLYING AN OXIDATIVE HAIR DYE AND METHOD OF REPEATEDLY DYEING INDIVIDUAL HAIR STRANDS UNIFORMLY OR NON-UNIFORMLY WITH SAME

CROSS-REFERENCE

This is a divisional of U.S. patent application Ser. No. 10/790,385, filed Mar. 1, 2004, now U.S. Pat. No. 7,128,485 which was published as US Patent Application 2004/0194796. The present invention described and claimed hereinbelow is also described in the aforesaid US patent application, which provides the basis for a claim of priority for the present invention under 35 U.S.C. 120.

BACKGROUND OF THE INVENTION

The subject matter of the present invention is a method oxidative dyeing of individual hair strands of human head hair with an applicator for applying a reactive hair dyeing mixture to the hair strands. This applicator comprises two compartments including a first compartment for a hair dye composition and a second compartment for an oxidizing agent and a product-dispensing area or spot for dispensing both the dye composition and the oxidizing agent.

These types of applicators are known as a two-component container in the most different forms. A peroxide solution is used as oxidizing agent. The dye composition and the oxidizing agent are present in the applicator, but are both separate from each other. Shortly before using the applicator both components are mixed by pushing one of the stoppers separating the compartments out and are thus activated. A reactive hair dye results from the mixture, which is dispensed through the product-dispensing opening of the applicator on the hair to be dyed. One type of applicator of this sort is described in DE 198 12 660 A1.

The known applicator has the disadvantage that after activation of the applicator the entire amount of the reactive dye must be consumed within a certain comparatively short time. After that short time it is no longer usable. Removal of only a portion of the hair dye is not possible in the case of the conventional applicator. These conventional applicators are little suited to the case in which only a small amount of dye is required, e.g. for hair strand dyeing.

SUMMARY OF THE INVENTION

It is an object of the present invention to further develop and improve an applicator of the above-described kind so that repeated removals of partial amounts of the hair dyeing mixture are possible within a comparatively greater time interval.

It is a further object of the present invention to provide a method of dyeing individual hair strands of human head hair uniformly or non-uniformly in a point-like or spot-like pattern with the applicator according to the invention.

These objects and others, which will be made more apparent hereinafter, are attained in an applicator for applying an oxidative hair dye to human hair comprising two compartments including a first compartment for a hair dye composition, a second compartment for an oxidizing agent and a product-dispensing area or spot for dispensing both the dye composition and the oxidizing agent.

According to the invention a product-dispensing opening is provided in each compartment and these product-dispensing openings open next to each other.

The applicator according to the invention has the advantage that it is suitable for repeatedly dispensing partial amounts of the hair dyeing mixture, also within a greater time interval.

The product-dispensing openings of the two compartments are next to each other so that both the oxidative hair dye and peroxide solution only come into contact with each other outside of the applicator. Both components available at the product-dispensing spot or area can be used e.g. for dyeing a hair strand. Thus the product is worked or massaged into the hair strand by hand in order to achieve first a uniform mixing of the components with each other and second a uniform product distribution along the hair strand.

Since the hair dye is first activated by contact with the peroxide solution, the components found within the applicator remain stable for a comparatively long time. Then a reactive mass, comprising the oxidative hair dye and the oxidizing agent, is prepared at the product-dispensing spot or area during a subsequent removal of another partial amount from the applicator.

Preferred embodiments are claimed in the appended claims and described in the description provided hereinbelow.

If a liquid-permeable insert made of spongy material, bristles or a fabric, especially of felt, is provided in each product-dispensing opening, a uniform dispensing of both components in a certain volumetric ratio occurs through these inserts. However this is better achieved when the respective inserts and/or their permeability is or are adjusted to the viscosities of the components flowing through them. For a direct application of the product on a strand it is advantageous that the inserts protrude beyond the product-dispensing openings to some extent, preferably from 1 to 10 mm. The protruding inserts can be used to apply, i.e. to coat or paint, the product on the hair strand.

In a preferred embodiment one product-dispensing opening is centrally located in the applicator and has a circular cross-section, while another outer product-dispensing opening is annular or ring-shaped and surrounds the one product-dispensing opening. The component dispensed from the inner product-dispensing opening wets the hair strand continuously followed by the component from the outer product-dispensing opening, uniformly guided or conducted in the direction of the applicator. The applicator is held about its longitudinal axis at that angular position. In this arrangement the product-dispensing openings geometrically fit a cylindrical first compartment, which is surrounded by a second compartment with an annular cross-section.

In order to be able to prevent an undesirable contact of the one component with the other component, the one compartment, e.g. the first compartment, can be formed so that it is exchangeable according to a preferred embodiment. Then the filled compartments can be prepared separately from each other. By inserting a new first compartment in a remaining portion of the applicator the applicator is again ready to function. In an easily made and economical embodiment the first compartment is inserted together with its insert in its product-dispensing opening in the remaining portion of the applicator. This arrangement can be used to prepare different hair dyes in different colors according to choice with the same applicator with the various first compartments inserted.

In connection with this embodiment the first compartment could be pushed into the applicator through an opening in the base of a remaining portion of the applicator. A stop can be provided on the first compartment so that the first compartment rests at a desired position in the applicator. The separately prepared compartment should have a sealing member or closure exactly like the rest of the applicator comprising only one compartment. The closure of the separate compartment is then removed prior to its insertion.

In another preferred embodiment a covering foil is provided for covering the product-dispensing spot or area. The covering foil is connected in a liquid-tight seal with the walls of the compartments, especially by welding or soldering. Because of that the components avoid drying out as well as an unintended mixing at the borders of both product-dispensing openings.

The separate compartments may be protected from drying out in a similar way when a covering foil is provided for covering each product-dispensing opening.

BRIEF DESCRIPTION OF THE SEVERAL VIEWS OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
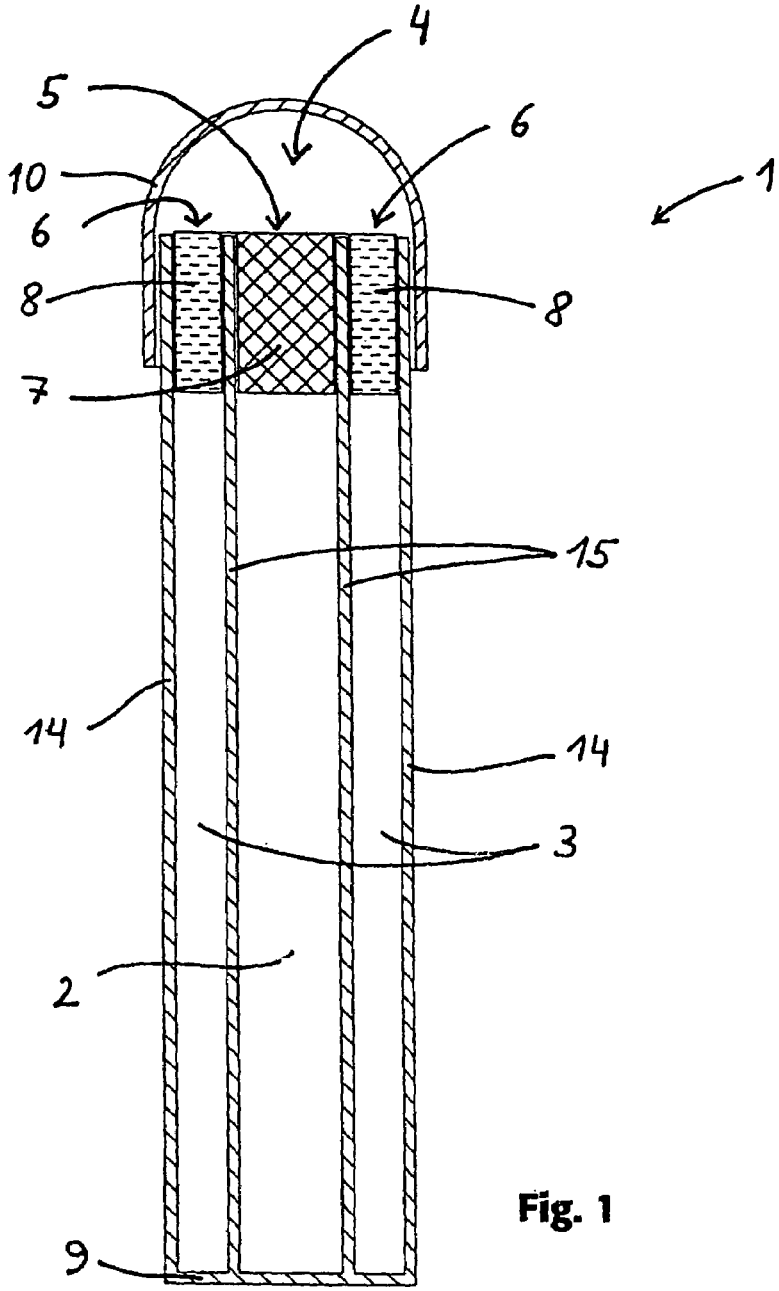
FIG. 1 is a vertical cross-sectional view of a first embodiment of an applicator for dyeing hair according to the invention, which comprises an interior compartment for an oxidative hair dye, an exterior annular cross-sectioned compartment for a peroxide solution, respective felt inserts in product-dispensing openings and a protective cap.
Figure 2:
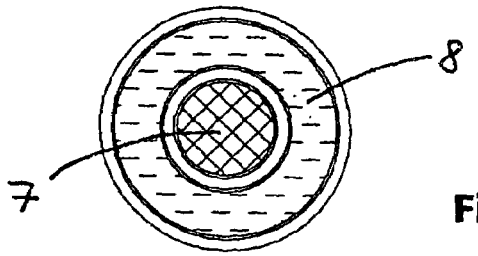
FIG. 2 is a top plan view of the applicator shown in FIG. 1, however without the protective cap.

An applicator 1 for applying an oxidative hair dye to human head hair has two compartments 2, 3. The first compartment 2 is formed for receiving an oxidation dye and the second compartment 3 is formed for receiving a peroxide solution (FIGS. 1 and 2). A product-dispensing spot or area 4 is provided for dispensing both the dye composition and the oxidizing agent embodied as the peroxide solution. Respective product-dispensing openings 5,6 are provided for each compartment 2,3. Both product-dispensing openings 5,6 open directly beside each other into the product-dispensing space or spot 4.

Respective liquid-permeable inserts 7,8 made from felt are inserted in corresponding product-dispensing openings 5,6. These inserts 7,8 project beyond the product-dispensing openings 5,6, in fact for about 1 mm.

A centrally arranged product-dispensing opening 5 with a circular cross-section is provided, which is surrounded concentrically by an outer ring-shaped or annular product-dispensing opening 6. Similarly a cylindrical compartment 2 is provided, which is surrounded or enclosed by a second compartment 3 with an annular cross-section.

A base 9 acts as a secure stand for the applicator 1. After removal of a protective cap 10 a filled applicator 1 is moved with the protruding inserts 7,8 over hair strands to be dyed. The hair strands thus are wet both with hair dye composition from insert 7 and also with peroxide oxidizing agent from insert 8 so that a reactive hair dyeing mixture is applied to or formed on the hair strands. A uniform hair strand dyeing can be achieved by continuously moving the applicator 1 along the strands. However a non-uniform, e.g. point-like or spot-like, dyeing of hair strands with the aim of achieving a certain strand pattern is also possible. Also for example respective equal sections of a hair strand, which are spaced from each other, can be dyed with the applicator 1 in order to alternate dyed and not-dyed sections of the hair strand and/or to produce a dyed strip or section on the hair strand.

Figure 3:
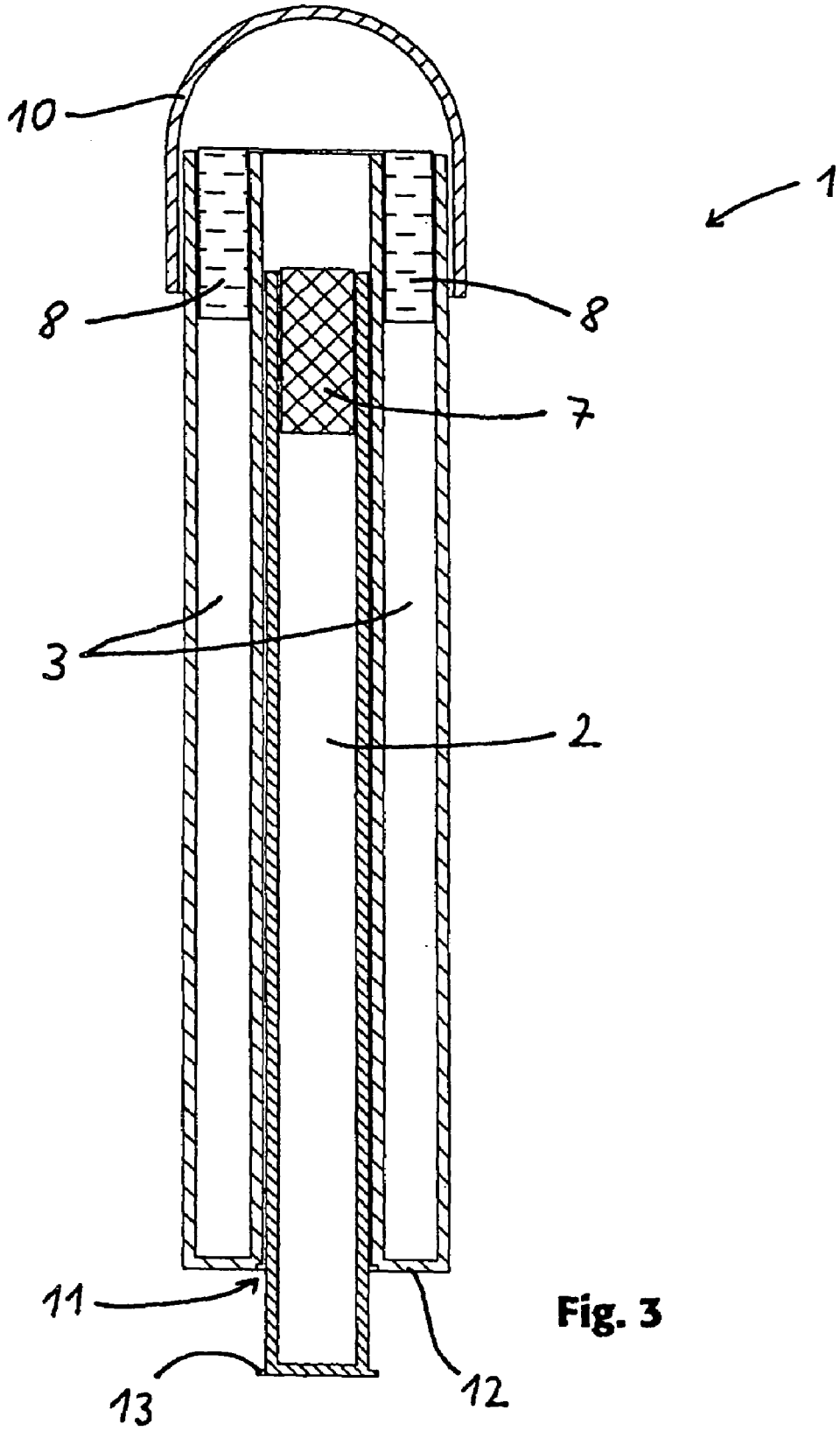
FIG. 3 is a vertical cross-sectional view of another embodiment of an applicator according to the invention, in which the inner compartment is exchangeable together with its felt insert.

In one other embodiment (FIG. 3) the inner compartment 2 is designed to be exchangeable. It can be pushed out of the applicator 1 together with the insert 7 located in its product-dispensing opening 5. After transporting the applicator 1 with a filled second compartment 3 separate from a filled first compartment 2, the filled first compartment 2 is inserted into the remaining part of the applicator 1 through an opening 11 in a base 12 of the applicator 1. A stop 13 is provided so that the first compartment 2 cannot travel beyond its desired final position in the applicator 1.

Figure 4:
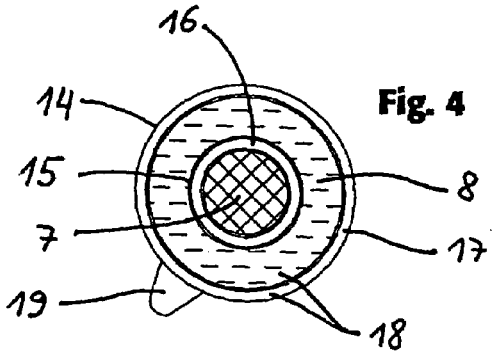
FIG. 4 is a top plan view of the applicator shown in FIG. 3, however with a covering foil over both product-dispensing openings.

In the embodiment of FIG. 4 a covering foil 18 for covering the product-dispensing spot or area 4 is provided. The covering foil 18 is connected in a liquid-tight manner with the walls 14,15 of the compartments 2,3 by means of two ring-shaped weld-joints or solder-joints 16,17 in order to prevent drying out of the products found in the compartments 2,3. A strip or tab 19 of the covering foil 18 provides a user with a better grip on the covering foil 18, in order to be able to easily remove it prior to a first use of the applicator 1.

Figure 5:
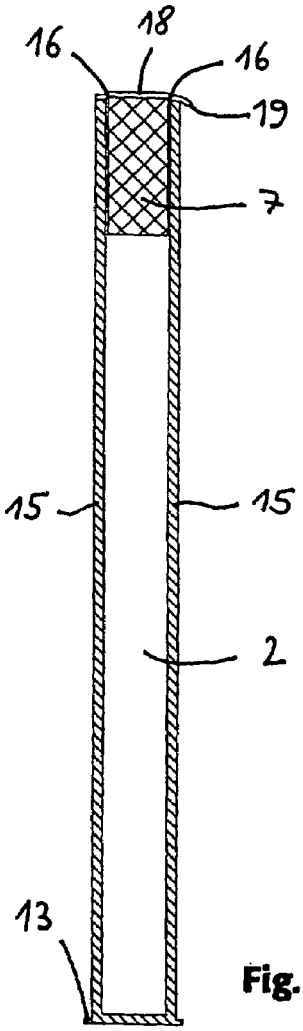
FIG. 5 is a vertical cross-sectional view through a first compartment in use, in which the product-dispensing opening is closed by means of a covering foil.
Figure 6:
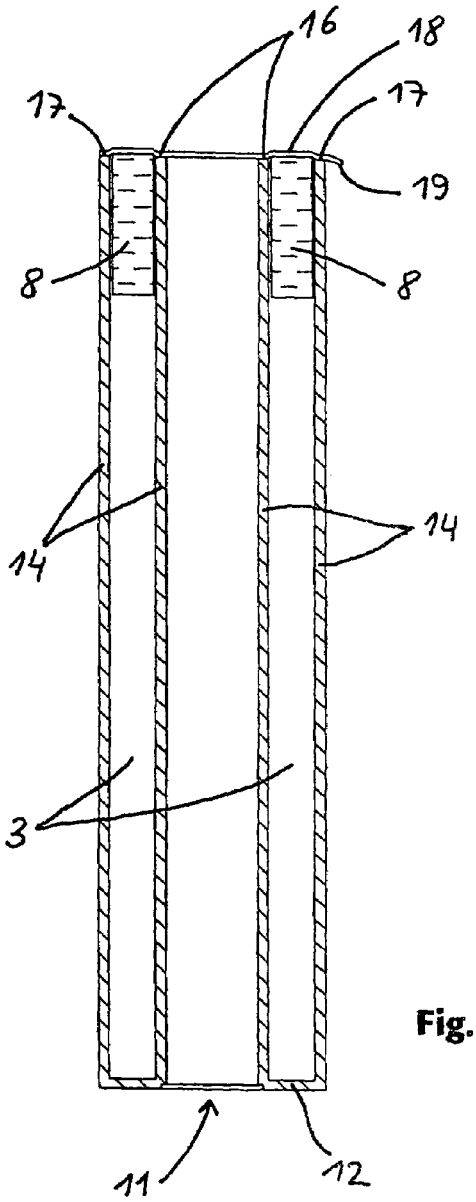
FIG. 6 is a vertical cross-sectional view through a remaining portion of an applicator according to the invention without the first compartment shown in FIG. 5, whose single compartment is closed by means of a covering foil.

In the embodiment according to FIGS. 5 and 6 respective covering foils 18 are provided for covering corresponding product-dispensing openings 5,6 of compartments or chambers 2,3. While the wall 15 of the compartment 2 (FIG. 5) is connected with the covering foil 18 by means of a single circumferential weld-seam or solder-seam 16, the wall 14 of the compartment 3 is sealed with the covering foil 18 by means of two concentric ring-shaped weld-seams or solder-seams 16,17 (see FIG. 6). After removing both covering foils 18 the article shown in FIG. 5 is pushed in the article shown in FIG. 6 in order to provide the functioning applicator.

The disclosure in German Patent Application 103 15 550.3 of Apr. 5, 2003 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in an applicator for applying an oxidative hair dye, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

I claim:

1. A method of oxidative dyeing of individual hair strands of human head hair, said method comprising the steps of:

a) providing an applicator comprising a first compartment, a second compartment arranged next to the first compartment, an oxidative hair dye composition contained in the first compartment, an oxidizing agent contained in the second compartment, and respective liquid-permeable inserts arranged in said first compartment and said second compartment; wherein said first compartment and said second compartment are provided with respective product-dispensing openings that open next to each other into a product-dispensing area or spot, said respective liquid-permeable inserts protrude beyond said product-dispensing openings, and said liquid-permeable inserts (7,8) each comprise a spongy material, bristles, or a fabric so that the oxidizing agent and the oxidative hair dye composition can flow through the inserts;

b) wetting at least a portion of a hair strand to be dyed with the oxidative hair dye composition and the oxidizing agent from the respective liquid-permeable inserts so that a reactive hair dyeing mixture forms on said at least a portion of said hair strand;

c) working or massaging the reactive hair dyeing mixture into said at least a portion of said hair strand by hand in order to uniformly mix the oxidative hair dye composition and the oxidizing agent on said at least a portion of said hair strand to uniformly dye said at least a portion of said hair strand; and d) repeating steps b) and c) for other hair strands and/or other portions of said hair strand until the dyeing of the hair strands is complete.

2. The method as defined in claim 1, further comprising moving the applicator continuously over said hair strand to be dyed to uniformly and entirely dye the hair strand to be dyed.

3. The method as defined in claim 1, further comprising moving the applicator only over spaced-apart regions of said hair strand in order to achieve a point-like or spot-like dyeing of the hair strand to obtain a predetermined pattern.

4. The method as defined in claim 1, further comprising dividing the hair strand to be dyed into respective equal sections and wetting only one of the sections of the hair strand with the oxidative hair dye composition and the oxidizing agent from said respective liquid-permeable inserts and repeating the dividing and wetting for other adjacent hair strands, so that alternating dyed and not-dyed sections of the hair are formed.

5. The method as defined in claim 1, wherein the applicator includes a removable protective cap that closes the product-dispensing openings when placed over the product-dispensing openings in order to be able to repeatedly dispense partial amounts of the oxidative hair dye composition and the oxidizing agent at various times over an extended time interval, and further comprising using the applicator to dye a first group of said hair strands at one time and then a second group of hair strands at another later time.

6. The method as defined in claim 1, wherein the applicator includes detachable covering foils connected in a liquid-tight manner with walls of the first compartment and the second compartment so that the product-dispensing openings are closed, and further comprising removing the covering foils in order to open the product-dispensing openings prior to the wetting of the at least a portion of the hair strand with the oxidative hair dye composition and the oxidizing agent.

7. The method as defined in claim 6, wherein said covering foils comprise a strip or tab for easy removal of the covering foils from the product-dispensing openings.

8. The method as defined in claim 1, wherein the first compartment is cylindrical and the second compartment surrounds the first compartment and has an annular cross-section, and further comprising keeping the first compartment separate from said second compartment prior to the wetting of the at least a portion of the hair strand with the oxidative hair dye composition and the oxidizing agent.

9. The method as defined in claim 1, wherein said oxidizing agent is a peroxide solution.

* * * * *